US006333727B2

(12) United States Patent
Mizumaki

(10) Patent No.: US 6,333,727 B2
(45) **Date of Patent: *Dec. 25, 2001**

(54) IMAGE DISPLAY DEVICE AND IMAGE DISPLAY METHOD

(75) Inventor: Hidetaka Mizumaki, Nara (JP)

(73) Assignee: Sharp Kabushiki Kaisha, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/166,934

(22) Filed: Oct. 6, 1998

(30) Foreign Application Priority Data

Oct. 8, 1997 (JP) ..... 9-276218

(51) Int. Cl.[7] ..... A63F 9/22
(52) U.S. Cl. ..... 345/89; 345/690; 345/90
(58) Field of Search ..... 345/89, 690, 90

(56) References Cited

U.S. PATENT DOCUMENTS 5,270,688 * 12/1993 Dawson et al. ..... 345/150
5,483,634 * 1/1996 Hasegawa ..... 395/501
5,699,078 * 12/1997 Yamazaki et al. ..... 345/147
5,704,836 * 1/1998 Norton et al. ..... 463/36
5,739,808 * 4/1998 Suga et al. ..... 345/147
5,790,096 * 8/1998 Hill, Jr. ..... 345/150
6,064,359 * 5/2000 Lin et al. ..... 345/89

FOREIGN PATENT DOCUMENTS 63-156487 A 6/1988 (JP) .

OTHER PUBLICATIONS

Nikkei Electronics, No. 666, Jul. 15, 1996, pp. 110–115.

* cited by examiner

*Primary Examiner*—Bipin Shalwala
*Assistant Examiner*—Vincent E. Kovalick
(74) *Attorney, Agent, or Firm*—Nixon & Vanderhye PC

(57) ABSTRACT

An image display device of the present invention includes: a memory for storing a display level of each pixel in a display screen; and a control section for comparing a display level of a pixel stored in the memory with a display level of the pixel for a next display, and for updating or not updating the display level of the pixel stored in the memory based on a comparison result.

5 Claims, 7 Drawing Sheets

PRIOR ART

FIG. 7 PRIOR ART
| Frame number \ Gray-scale level | 0 | 1 | 2 | 3 |
|---|---|---|---|---|
| 1 | 0 | 1 | 1 | 1 |
| 2 | 0 | 0 | 1 | 1 |
| 3 | 0 | 0 | 0 | 1 |
FIG. 8A PRIOR ART
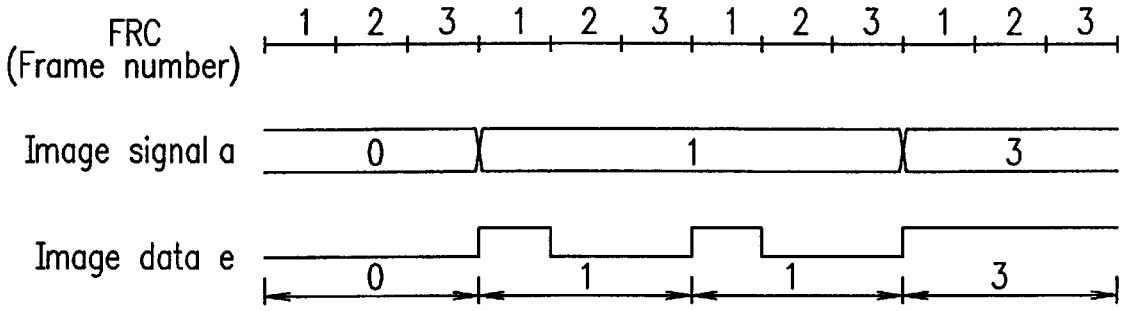
FIG. 8B PRIOR ART
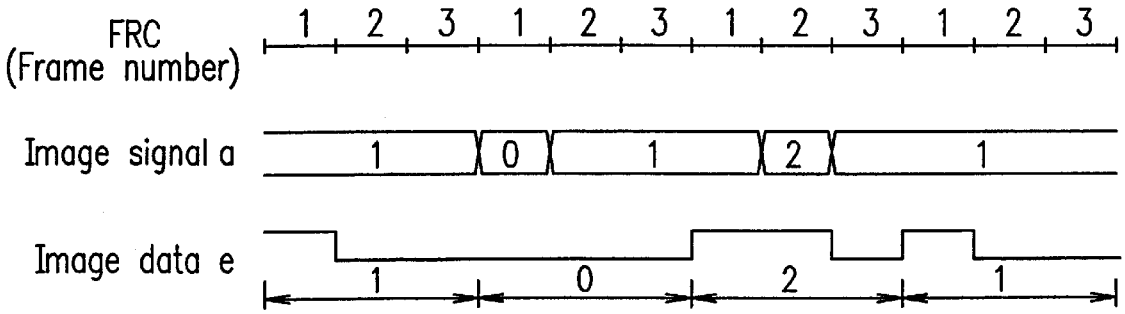

IMAGE DISPLAY DEVICE AND IMAGE DISPLAY METHOD

BACKGROUND OF THE INVENTION

1. Field of the Invention

The present invention relates to an image display device and an image display method for displaying an image on a screen.

2. Description of the Related Art

CRTs (cathode ray tubes) have been used for many years as display devices for computers. CRTs are still widely used because they are inexpensive. However, a CRT requires a large area for installation and is likely to have image distortion. Moreover, it is difficult to reduce its power consumption. In contrast, an LCD (liquid crystal display) does not require a large area for installation, and is not likely to have image distortion. Moreover, it is relatively easy to reduce LCD power consumption. Therefore, LCDs are expected to replace CRTs in the future.

In order to drive an LCD device, an LCD image signal can be input to the LCD device directly from a computer, or a CRT image signal output from a computer can be converted into an LCD image signal and input to the LCD device.

FIG. 5 illustrates a conventional device for converting a CRT image signal into an LCD image signal. The device includes an image amplifier 10 for amplifying a CRT image signal "a" and outputting an amplified image signal "b", an A/D converter 11 for performing an A/D conversion for the image signal "b" and outputting image data "c", and a memory 12 having a capacity sufficient for storing at least one frame (corresponding to one screen) of image data "c". The device further includes a memory controller 13 for controlling write and read operations of the memory 12, and an LCD controller 14 for converting image data "d" output from the memory 12 into an LCD image signal "e" and outputting the LCD image signal "e".

The image amplifier 10 shapes the waveform of the analog CRT image signal "a" and outputs the resulting image signal "b" to the A/D converter 11. The A/D converter 11 converts the image signal "b" into the digital image data "c" so that the signal can be easily handled by an LCD device, and outputs the image data "c" to the memory 12. The memory controller 13 receives the CRT image signal "a" through a path (not shown). The memory controller 13 produces, using a PLL (phase locked loop) circuit provided therein, a write control signal "f" which is in synchronization with a synchronization signal of the image signal "a", and outputs the write control signal "f" to the memory 12. The memory controller 13 also produces a read control signal "g" which is in synchronization with a clock signal (generated by a reference clock circuit provided in the memory controller 13) and outputs the read control signal "g" to the memory 12. The memory 12 successively receives and stores the image data "c" from the A/D converter 11 in synchronization with the write control signal "f", and successively outputs the image data "d" to the LCD controller 14 in synchronization with the read control signal "g". The LCD controller 14 converts the image data "d" into the image signal "e" which is more suitable for driving the LCD device, and outputs the image signal "e" to the LCD device.

As described above, the memory controller 13 generates the write control signal "f " in synchronization with the synchronization signal of the image signal "a", and generates the read control signal "g" in synchronization with the clock signal generated in the memory controller 13.

Therefore, the write control signal "f" and the read control signal "g" are not in synchronization with each other, and the write operation of the image data "c" and the read operation of the image data "d" are not in synchronization with each other. This is because the synchronization timing of the CRT image signal "a" varies depending upon the resolution of the CRT, whereby the synchronization timing of the image data "c" (which is obtained through an A/D conversion of the image signal "a"), may not match the synchronization timing of the LCD image data "d". Thus, it is required that the memory 12 functions as a buffer, and that the memory controller 13 is provided along with the memory 12. If the synchronization timing of the CRT image signal "a" matches the synchronization timing of the LCD image signal "e", then, the memory 12 and the memory controller 13 are optional.

However, if noise is included in the image signal "a" input to the image amplifier 10 in the device illustrated in FIG. 5, the noise is also converted by the A/D converter 11 and by the LCD controller 14. In such a case, the LCD image signal "e" includes the noise, which disturbs the display of the LCD device.

Referring to FIG. 6, consider a situation where frames 21, 22, . . . , 26 are to be successively displayed, wherein a certain pixel 27 at one screen position is supposed to maintain a gray-scale level value of 50 throughout the. frames 21 to 26. If noise is included in the image signal "a", the gray-scale level for the pixel 27 may vary from 50 to 49, 50, 50, 51 and 50 for the frames 21 to 26, respectively. Accordingly, binary pixel data representing the gray-scale level of the pixel 27 (included in the digitized image data "c" from the A/D converter 11) may vary from 110010 to 110001, 110010, 110010, 110011 and 110010.

The degree of the variation in the pixel data included in the digitized image data "c" is dependent upon the level of the noise included in the CRT image signal "a", and it may be insignificant. In fact, in a display method where the entire image data is updated after each frame, such variation is often imperceptible to human eyes. In a display method where one image is displayed by using a plurality of frames, however, the variation in the pixel data may be distributed to the plurality of frames. In other words, when the number of gray-scale levels represented by an analog image signal "a" cannot be represented by a single frame of image data "e", so that a number of frames of image data "e" are used to represent the number of gray-scale levels, the variation in the pixel data may be distributed to the number of frames.

For example, referring to FIG. 7, assume that the number of gray-scale levels of one pixel which can be represented by the analog image signal "a" is 4, while the number of gray-scale levels which can be represented by the digitized pixel data is 2. In such a case, three frames are used to represent the gray-scale level for the pixel. When the gray-scale level of the pixel represented by the analog image signal "a" is 0, the gray-scale level is set to 0 throughout the three frames. When the gray-scale level of the pixel represented by the analog image signal "a" is 1, the gray-scale level is set to 1 for one of the three frames, and 0 for the other two frames.

Referring to a timing diagram illustrated in FIG. 8A, when the gray-scale level of a pixel represented by the analog image signal "a" is 0, the gray-scale level of the pixel is set to 0 for all of a set of three frames by the pixel data included in the image data "e". When the gray-scale level of a pixel represented by the analog image signal "a" is 1, the gray-scale level of the pixel is set to 1 for the first one of the three frames, and 0 for the following two frames.

FIG. 8B illustrates a timing diagram, similar to that illustrated in FIG. BA, in a situation where the gray-scale level of the pixel represented by the image signal "a" is supposed to be 1 throughout the illustrated frames, but the gray-scale level varies to 0 or 2 due to noise included in the image signal "a". In such a case, although the first set of three frames may appropriately represent the gray-scale level of 1, the second three frames may represent the gray-scale level of 0, and the third three frames may represent the gray-scale level of 2, as illustrated in FIG. 8B. Thus, the gray-scale level of the pixel may fluctuate.

Particularly, when the display device is used in a computer, on which a static image is often displayed, the noise included in the image signal "a" may result in a flicker on the display screen, which is likely to be perceptible.

While it is difficult to completely eliminate such an influence of the noise included in the image signal, the influence should be at least minimized. Japanese Laid-open Publication No. 63-156487 discloses a method for detecting changes in the level of a CRT image signal. However, the disclosed method does not positively address the above-described problems based on the detected changes in the level of the image signal.

SUMMARY OF THE INVENTION

According to one aspect of this invention, an image display device includes: a memory for storing a display level of each pixel in a display screen; and a control section for comparing a display level of a pixel stored in the memory with a display level of the pixel for a next display, and for updating or not updating the display level of the pixel stored in the memory based on a comparison result.

In one embodiment of the invention, the control section updates the display level of the pixel stored in the memory if a difference between the display level of the pixel stored in the memory and the display level of the pixel for the next display is equal to or greater than a predetermined threshold value.

In one embodiment of the invention, a display level of each pixel is represented by a bit string. The control section compares a first bit string representing the display level of the pixel stored in the memory with a second bit string representing a display level of the pixel for a next display, and for updating the display level of the pixel stored in the memory if a predetermined number of upper bits of the first bit string differ from the predetermined number of upper bits of the second bit string.

According to another aspect of this invention, an image display method includes the steps of: storing a display level of each pixel in a display screen; comparing a display level of a pixel stored in the memory with a display level of the pixel for a next display; and updating or not updating the display level of the pixel stored in the memory based on a comparison result.

In one embodiment of the invention, the updating step includes the step of updating the display level of the pixel stored in the memory if a difference between the display level of the pixel stored in the memory and the display level of the pixel for the next display is equal to or greater than a predetermined threshold value.

According to still another aspect of this invention, an image display device includes: a conversion section for converting an analog image signal into digital image data; a memory for temporarily storing at least one frame of image data after being converted by the conversion section, and for outputting the image data; and a control section for comparing the display level of the pixel represented by the one frame of image data stored in the memory with a display level of the same pixel represented by a next one frame of image data after being converted by the conversion section, and for updating or not updating the display level of the pixel stored in the memory based on a comparison result.

In one embodiment of the invention, the control section updates the display level of the pixel stored in the memory if a difference between the display level of the pixel represented by the image data stored in the memory and the display level of the pixel represented by a next frame of image data is equal to or greater than a predetermined threshold value.

In one embodiment of the invention, a display level of each pixel is represented by a bit string. The control section compares a first bit string representing the display level of the pixel stored in the memory with a second bit string representing a display level of the pixel for a next display, and for updating the display level of the pixel stored in the memory if a predetermined number of upper bits of the first bit string differ from the predetermined number of upper bits of the second bit string.

As described above, in the image display device of the present invention, a display level of a pixel stored in the memory is updated only when the difference between the display level of the pixel stored in the memory and a display level of the same pixel for the next display is significant. When the difference is insignificant, the display level of the pixel in the memory is not updated. Therefore, when the display level of the pixel for the next display varies only slightly due to noise, the display level of the pixel stored in the memory is not updated, thereby preventing the display level of the pixel on the display screen from fluctuating due to such noise. The image display method of the present invention also provides the same effect.

Thus, the invention described herein makes possible the advantages of: (1) providing an image display device capable of suppressing the influence of noise included in an image signal so as to prevent flicker on a display screen due to the noise; and (2) providing an image display method capable of suppressing the influence of noise included in an image signal so as to prevent flicker on a display screen due to the noise.

These and other advantages of the present invention will become apparent to those skilled in the art upon reading and understanding the following detailed description with reference to the accompanying figures.

BRIEF DESCRIPTION OF THE DRAWINGS

FIG. 7 is a chart illustrating how to represent four gray-scale levels using three frames;

FIG. 8A is a timing diagram illustrating signals used in an image display device; and FIG. 8B is a timing diagram illustrating signals used in an image display device when the signals are influenced by noise.

DESCRIPTION OF THE PREFERRED EMBODIMENTS

The present invention will now be described by way of an illustrative example with reference to the accompanying figures.

Figure 1:
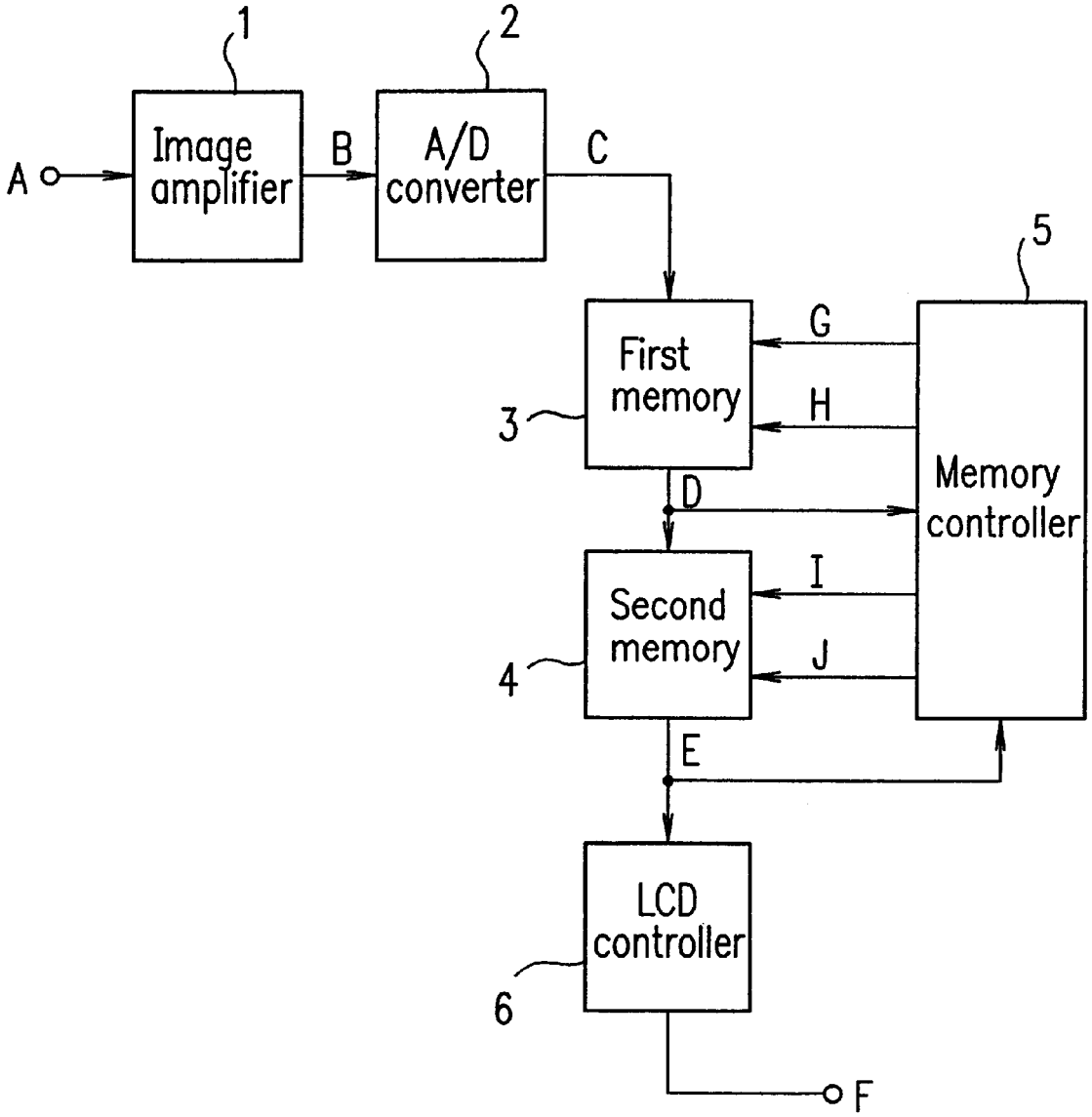
FIG. 1 is a block diagram illustrating an image display device according to an example of the present invention.

FIG. 1 illustrates an image display device according to an example of the present invention. The device includes an image amplifier 1 for amplifying a CRT image signal A and outputting an amplified image signal B, an A/D converter 2 for performing an A/D conversion for the image signal B and outputting image data C, and a first memory 3 and a second memory 4 each having a capacity sufficient for storing at least one frame (corresponding to one screen) of image data C. The device further includes a memory controller 5 for controlling write and read operations of the first and second memories 3 and 4, and an LCD controller 6 for converting image data E output from the second memory 4 into an LCD image signal F and outputting the LCD image signal F.

The image amplifier 1 shapes the waveform of the analog CRT image signal A and outputs the resulting image signal B to the A/D converter 2. The A/D converter 2 converts the image signal B into digital image data C so that the signal can be easily handled by an LCD device. The image data C is temporarily stored in the first memory 3, passed to the second memory 4, and then output from second memory 4. The memory controller 5 receives the CRT image signal A through a path (not shown). The memory controller 5 produces, using a PLL circuit provided therein, a write control signal G which is in synchronization with a synchronization signal of the image signal A, and outputs the write control signal G to the first memory 3. The memory controller 5 also produces read control signals H and J and a write control signal I which are all in synchronization with a clock signal (generated by a reference clock circuit provided in the memory controller 5) and outputs the read control signals H and J to the first and second memories 3 and 4, respectively, and the write control signal I to the second memory 4. The first memory 3 successively receives and stores the image data C from the A/D converter 2 in synchronization with the write control signal G, and successively outputs image data D to the second memory 4 in synchronization with the read control signal H. The second memory 4 successively receives the image data D in synchronization with the write control signal I, and successively outputs the image data E to the LCD controller 6 in synchronization with the read control signal J. The LCD controller 6 converts the image data E into the image signal F which is more suitable for driving the LCD device, and outputs the image signal F to the LCD device.

Therefore, while one frame of image data E is output from the second memory 4, the next frame of image data D is output from the first memory 3, and the third frame of image data C (subsequent to the frame of image data D) is input to the first memory 3. Thus, at least two frames of image data are always stored in the first and second memories 3 and 4, respectively.

As described above, the write control signal G is in synchronization with the synchronization signal of the image signal A, whereas the read control signals H and J and the write control signal I are in synchronization with the clock signal. Therefore, the read control signals H and J and the write control signal I are in synchronization with one another, but the write control signal G is not in synchronization with the read control signals H and J and the write control signal I. This is because the synchronization timing of the CRT image signal A varies depending upon the resolution of the CRT, whereby the synchronization timing of the image data C, which is obtained through an A/D conversion of the image signal A, may not match the synchronization timing of the LCD image data D. Thus, it is required that the first memory 3 functions as a buffer, that and the memory controller 5 is provided along with the first memory 3. If the synchronization timing of the CRT image signal A matches the synchronization timing of the LCD image signal F, then the first memory 3 is optional.

Figure 2:
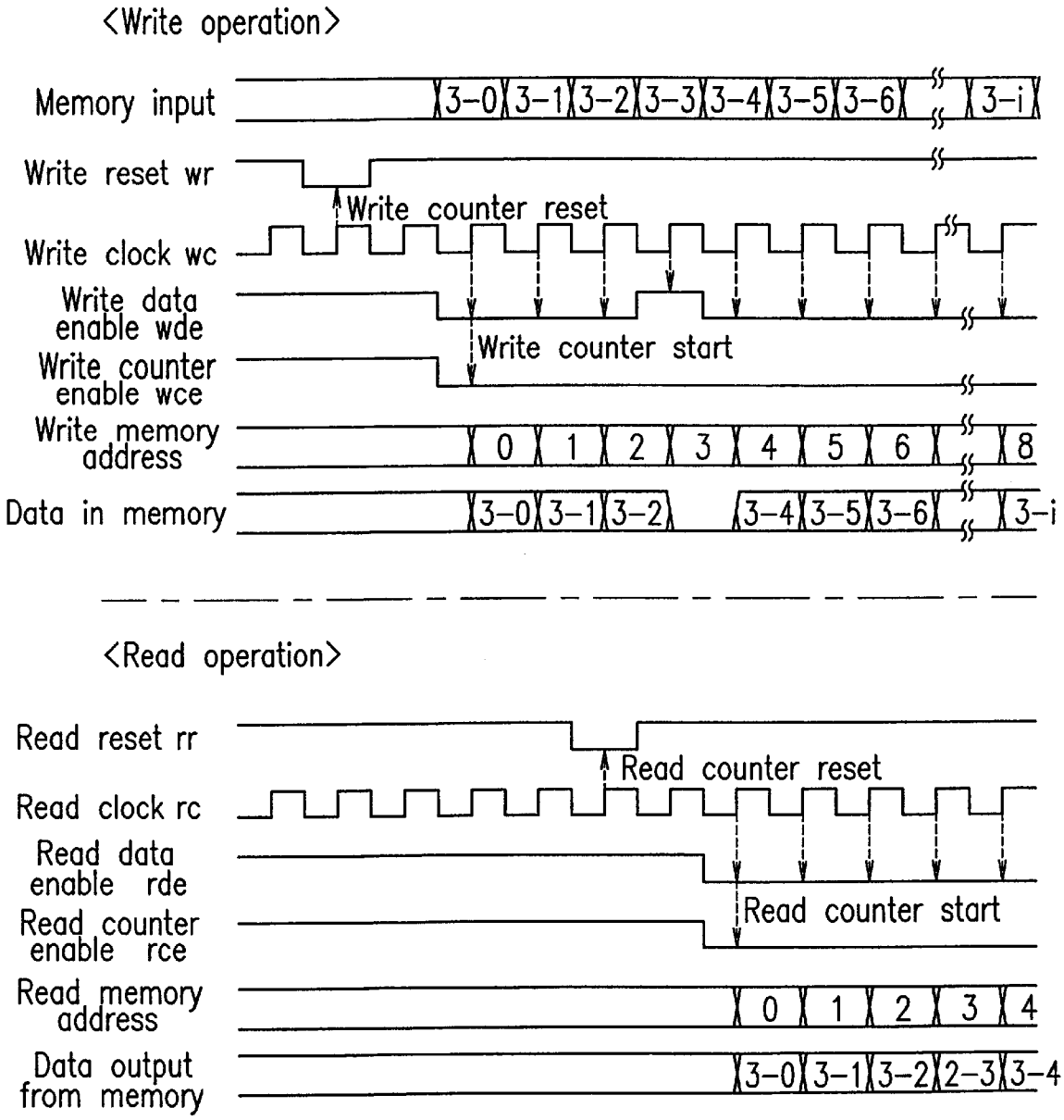
FIG. 2 is a timing diagram illustrating signals used in the device illustrated in FIG. 1.

FIG. 2 is a timing diagram illustrating write and read operations of the first and second memories 3 and 4.

Each of the write control signals G and I includes a write reset signal (wr), a write clock signal (wc), a write data enable signal (wde), a write counter enable signal (wce) and a write memory address. One frame of image data input to the memory includes pixel data points 3-0, 3-1, 3-2, . . . , 3-i, . . . , 3-n. (The left-hand side figure represents the frame number starting from 1, and the right-hand side figure represents the pixel data point number starting from 0. For example, "3-1" represents the second pixel data point in the third frame.)

After the write reset signal goes low, the write data enable signal and the write counter enable signal go low at a time when the input of pixel data into the memory starts, and the write memory address is initialized. At the next rise of the write clock signal, the write memory address is incremented, and the pixel data is written in the incremented write memory address. Thereafter, at each rise of the write clock signal, the write memory address is incremented, and the pixel data is written in the incremented write memory address.

When the write data enable signal is at a high level, the write memory address is incremented at the rise of the write clock signal, but the pixel data is not written. In the example illustrated in FIG. 2, when the pixel data 3-3 is input, the pixel data 3-3 is not written because the write data enable signal is at the high level.

The read control signals H and J each include a read reset signal (rr), a read clock signal (rc), a read data enable signal (rde), a read counter enable signal (rce) and a read memory address, as illustrated in FIG. 2.

After the read reset signal goes low, the read data enable signal and the read counter enable signal go low, and the read memory address is initialized. At the next rise of the read clock signal, the read memory address is incremented, and the pixel data is read from the incremented read memory address. Thereafter, at each rise of the read clock signal, the read memory address is incremented, and the pixel data is read from the incremented read memory address.

Figure 3:
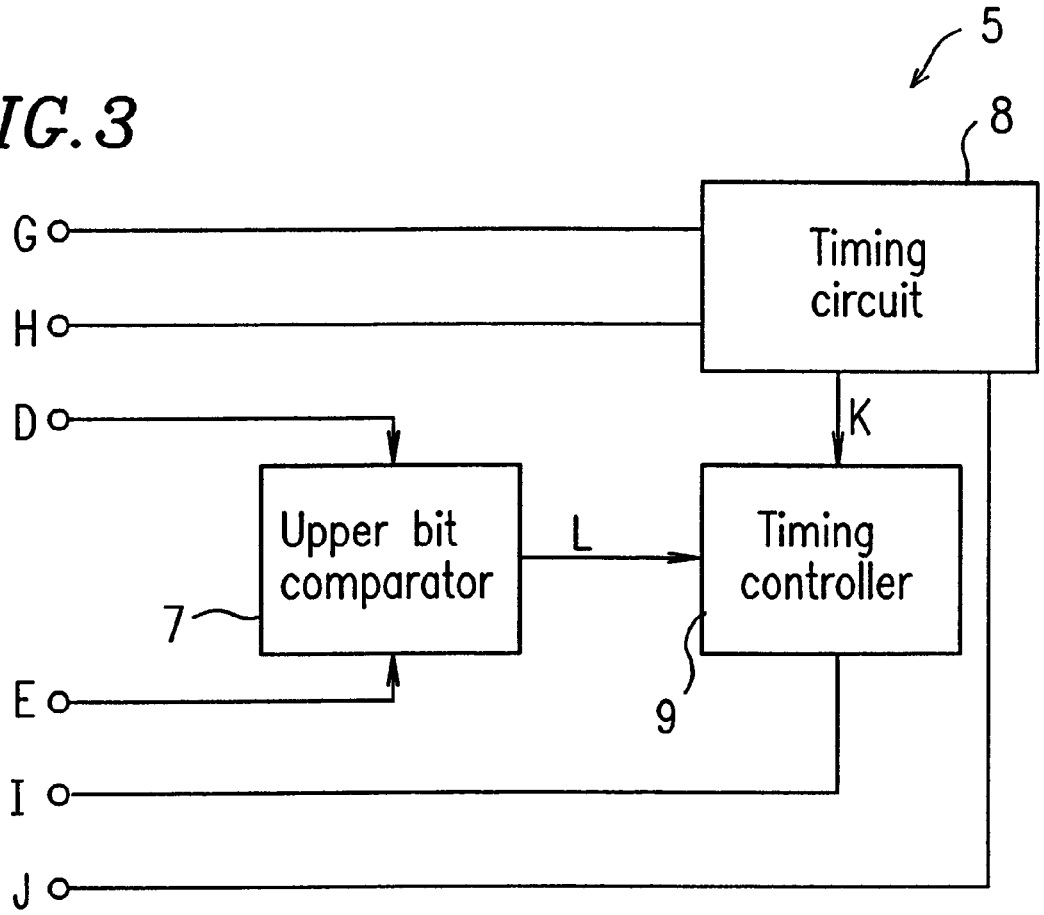
FIG. 3 is a block diagram illustrating a memory controller used in the device illustrated in FIG. 1.

FIG. 3 illustrates a configuration of the memory controller 5. The memory controller 5 includes an upper bit comparator 7, a timing circuit 8 and a timing controller 9. The timing controller 9 receives the CRT image signal A and produces the write control signals G in synchronization with the synchronization signal of the image signal A using a PLL circuit (not shown). The timing controller 9 also produces the read control signals H and J and a write control signal K which are all in synchronization with a clock signal generated by a reference clock circuit (not shown). The write control signal G and the read control signal H are directly output to the first memory 3, and the read control signal J is directly output to the second memory 4. The write control signal K is input to the timing controller 9, and the timing controller 9 outputs the write control signal I to the second memory 4.

The upper bit comparator 7 receives the image data D from the first memory 3 and the image data E from the second memory 4, and successively compares the respective pixel data points included in the image data D with the respective pixel data points included in the image data E. Thus, for each pixel in the display screen, the pixel data of the image data D representing the gray-scale level of the pixel is compared with the pixel data of the image data E representing the gray-scale level of the same pixel. The upper bit comparator 7 determines whether the difference between the gray-scale level represented by the pixel data of the image data D and the gray-scale level represented by the pixel data of the image data E is equal to or greater than a predetermined threshold value. The upper bit comparator 7 then outputs to the timing controller 9 a comparison signal L indicating the comparison result. The timing controller 9 controls the write control signal K based on the comparison signal L, thereby obtaining the write control signal I, which is output to the second memory 4.

Where each pixel data point includes 6 bits, for example, if the upper 4 bits of the pixel data point of the image data D match the upper 4 bits of the pixel data point of the image data E, it is determined that the gray-scale level difference is less than the threshold value. When the upper 4 bits of the pixel data point of the image data D do not match the upper 4 bits of the pixel data point of the image data E, it is determined that the gray-scale level difference is equal to or greater than the threshold value. In this case, the lower 2 bits in the pixel data point are used as the threshold value. In other words, it is determined whether the gray-scale level difference is so small that only the lower 2 bits of the pixel data do not match, or the gray-scale level difference is so great that even the upper 4 bits of the pixel data do not match.

Figure 4:
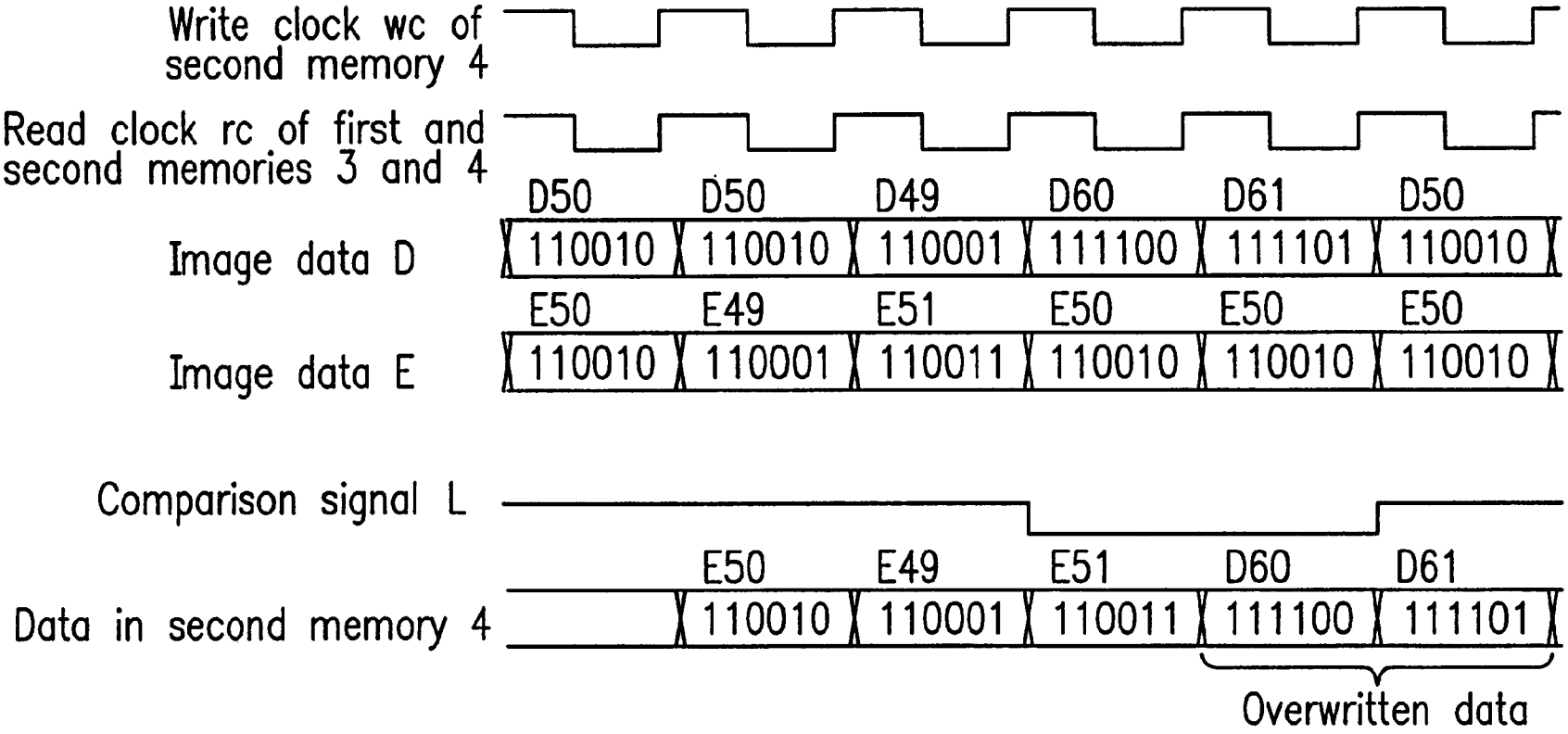
FIG. 4 is a timing diagram illustrating signals used in the memory controller illustrated in FIG. 3.
Figure 5:
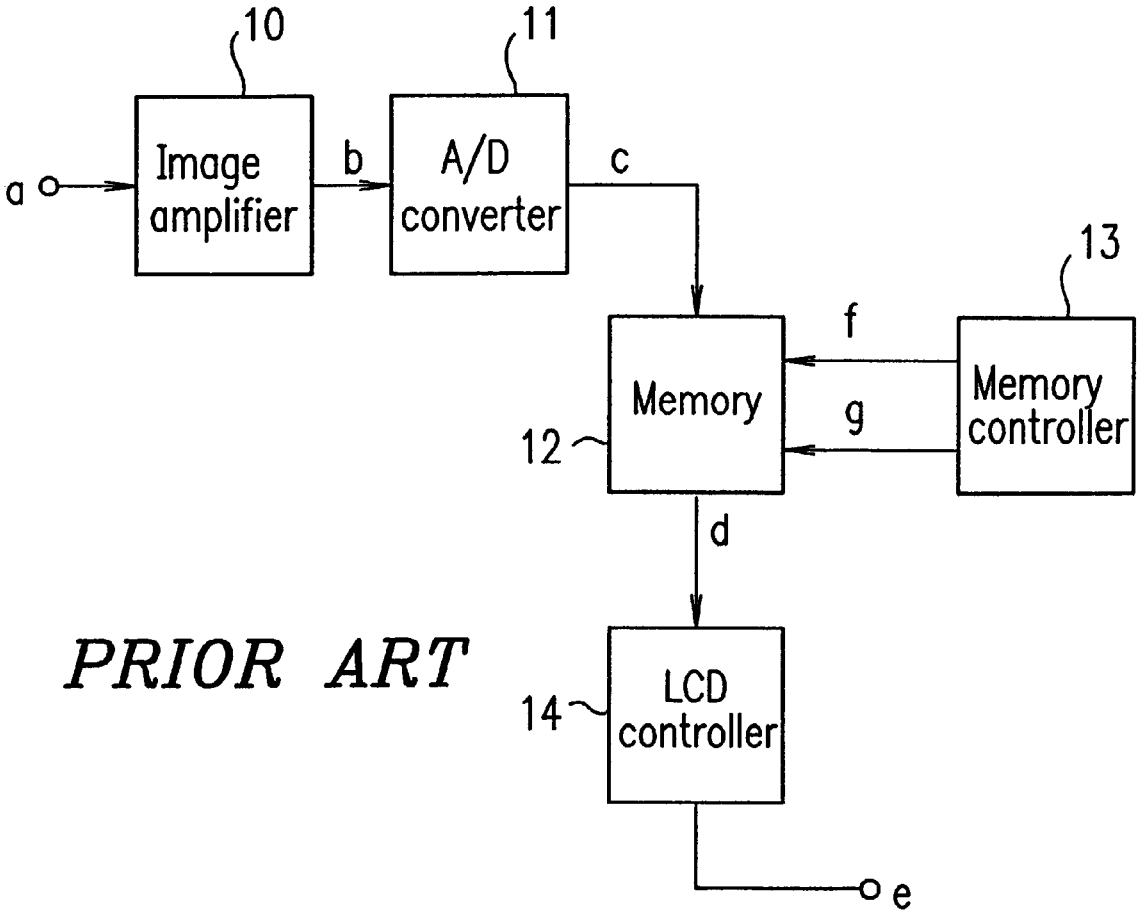
FIG. 5 is a block diagram illustrating a conventional device for converting a CRT image signal into an LCD image signal.

FIG. 4 is a timing diagram illustrating an operation of the memory controller 5. The image data D input to the second memory 4 includes a plurality of 6-bit pixel data points D50, D50, . . . The image data E output from the second memory 4 includes a plurality of 6-bit pixel data points E50, E49, . . . In the illustrated example, as the pixel data points D are input, the pixel data points E50, E49, E51, D60, D61, . . . , are written in the second memory 4.

In synchronization with the write clock signal (wc) included in the write control signal I and with the read clock signal (rc) included in the read control signal J, respectively, the upper bit comparator 7 successively receives the 6-bit pixel data points included in the pixel data D from the first memory 3 and the 6-bit pixel data points included in the pixel data E from the second memory 4, and compares the respective 6-bit pixel data points of the image data D with the respective 6-bit pixel data points of the image data E. Thus, for each pixel in the display screen, the pixel data of the image data D representing the gray-scale level of the pixel is compared with the pixel data of the image data E representing the gray-scale level of the same pixel, thereby successively determining whether the upper 4 bits of the pixel data match.

When the upper 4 bits of the pixel data do not match (e.g., when the gray-scale level difference is equal to or greater than the threshold value), the upper bit comparator 7 switches the comparison signal L to a low level for a time period during which such pixel data is input/output. While the comparison signal L is at the low level, the timing controller 9 holds the write data enable signal (wde) at a low level (see FIG. 2), and outputs to the second memory 4 the write control signal I including the write data enable signal (wde) at the low level.

While the write data enable signal (wde) of the write control signal I is at the low level, the second memory 4 writes and updates the pixel data.

When the upper 4 bits of the pixel data match (e.g., when the gray-scale level difference is less than the threshold value), the upper bit comparator 7 switches the comparison signal L to a high level for a time period during which such pixel data is input/output. While the comparison signal L is at the high level, the timing controller 9 holds the write data enable signal (wde) at the high level, and outputs to the second memory 4 the write control signal I including the write data enable signal (wde) at the high level.

While the write data enable signal (wde) of the write control signal I is at the high level, the second memory 4 does not write or update the pixel data. Thus, instead of the pixel data input to the second memory 4, the pixel data output from the second memory 4 remains stored in the second memory 4.

In other words, the pixel data of each pixel for one frame output from the second memory 4 is compared with the pixel data of the same pixel for the next frame. If the difference between the gray-scale level represented by the pixel data for the one frame and the gray-scale level represented by the pixel data for the next frame is less than a threshold value, the comparison signal L is held at the high level, the pixel data of the pixel stored in the second memory 4 is not updated so that the pixel data of the pixel output from the second memory 4 remains stored in the second memory 4, for a time period during which such pixel data is input/output. Therefore, if the difference is not significant, the pixel data of the pixel in the next frame is not updated, so that the gray-scale level of the pixel does not change in the next frame.

Figure 6:
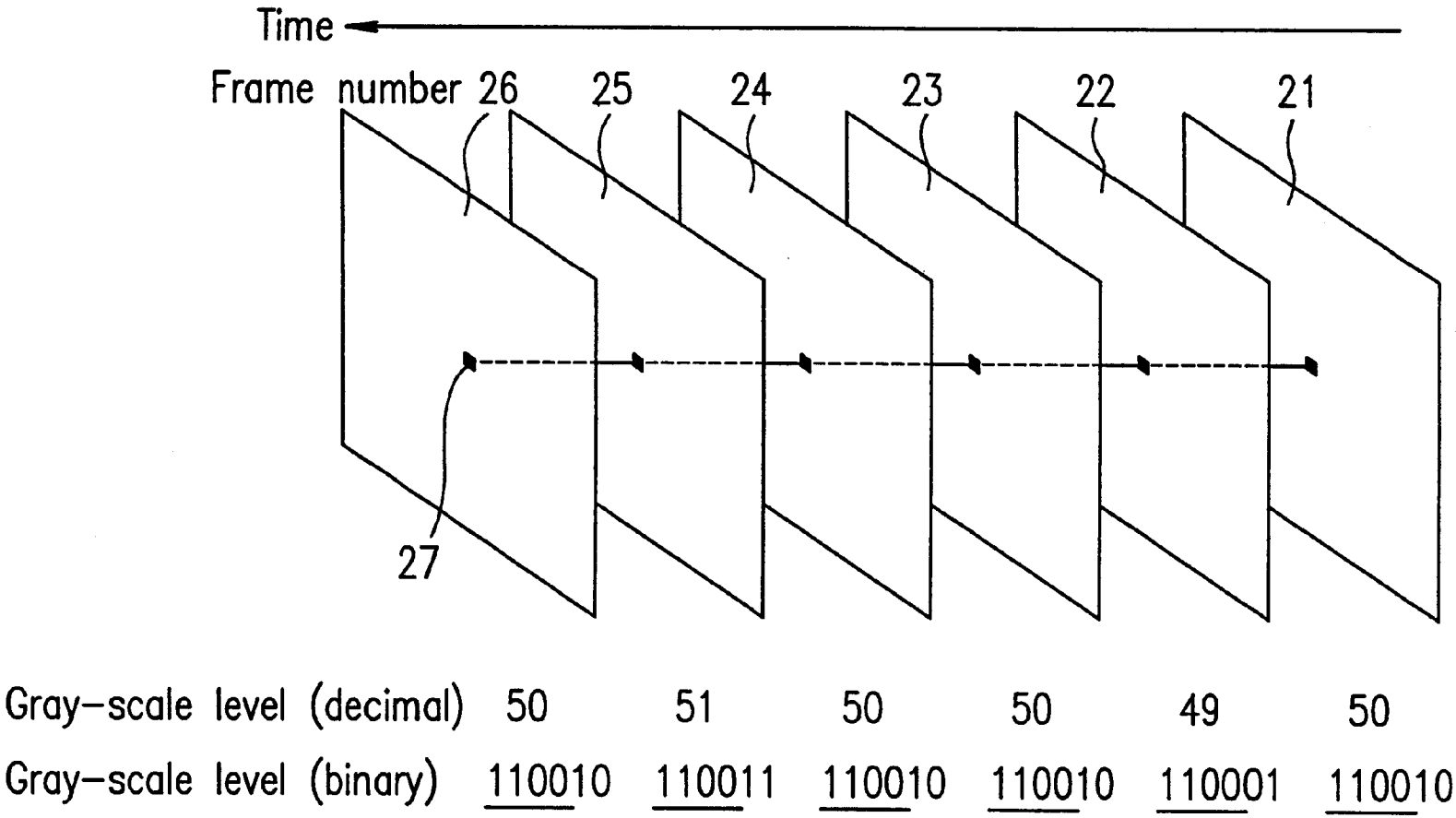
FIG. 6 PRIOR ART
FIG. 6 is a schematic diagram illustrating a plurality of frames displayed on a display screen.

Therefore, referring back to FIG. 6, even if the binary pixel data representing the gray-scale level of the pixel 27 varies from 110010 to 110001, 110010, 110010, 110011 and 110010, the pixel data of the pixel 27 stored in the second memory 4 is held at 10010, thereby not changing the gray-scale level of the pixel 27 (because these pixel data points vary only in the lower two bits).

Thus, when the gray-scale level of the pixel 27 varies slightly from one frame to another due to noise in the image signal A, the gray-scale level of the pixel 27 represented by the pixel data in the second memory 4 is kept at the same level, and the gray-scale level of the pixel 27 is therefore kept at the same level on the display screen of the LCD device.

When the gray-scale level of the pixel 27 changes significantly (e.g., when there is a motion or change in the image), the pixel data of the pixel 27 stored in the second memory 4 is updated. Thus, the normal image display function is maintained.

Such control of gray-scale level of a pixel suppresses flicker on the display screen, and is particularly advantageous for a display device for a computer on which a static image is often displayed.

The present invention is not limited to controlling of gray-scale level, but can also be used to control any other type of pixel data such as luminance, chromaticity, or chromaticness.

As described above, when the synchronization timing of the CRT image signal A matches the synchronization timing of the LCD image signal F, the first memory 3 may be omitted. In such a case, the pixel data of the pixel data E stored in the second memory 4 is compared with the pixel data of the pixel data D stored in the second memory 4. Based on the comparison result, it is determined whether the pixel data in the second memory 4 should be updated.

As described above, in the image display device of the present invention, a display level of a pixel stored in the memory is updated only when the difference between the display level of the pixel stored in the memory and a display level of the same pixel for the next display is significant. When the difference is insignificant, the display level of the pixel in the memory is not updated. Therefore, when the display level of the pixel for the next display varies only slightly due to noise, the display level of the pixel stored in the memory is not updated, thereby preventing the display level of the pixel on the display screen from fluctuating due to such noise. The image display method of the present invention also provides the same effect.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An image display device, comprising:

a memory for storing a display level of each pixel in a display screen; and a control section for comparing a display level of a pixel stored in the memory with a display level of the pixel for a next display, and for updating or not updating the display level of the pixel stored in the memory based on a comparison result, wherein when the comparison result indicates a slight variation in the display level, the control section does not update the display level of the pixel stored in the memory, wherein a display level of each pixel is represented by a bit string; and the control section compares a first bit string representing the display level of the pixel stored in the memory with a second bit string representing a display level of the pixel for a next display, and for updating the display level of the pixel stored in the memory if a predetermined number of upper bits of the first bit string differ from the predetermined number of upper bits of the second bit string.

2. An image display device according to claim 1, wherein the control section updates the display level of the pixel stored in the memory if a difference between the display level of the pixel stored in the memory and the display level of the pixel for the next display is equal to or greater than a predetermined threshold value.

3. An image display method, comprising the steps of:

storing a display level of each pixel in a display screen;

comparing a display level of a pixel stored in the memory with a display level of the pixel for a next display; and updating or not updating the display level of the pixel stored in the memory based on a comparison result, wherein when the comparison result indicates a slight variation in the display level, updating of the display level of the pixel stored in the memory is not performed, wherein the updating step comprising the step of updating the display level of the pixel stored in the memory if a difference between the display level of the pixel stored in the memory and the display level of the pixel for the next display is equal to or greater than a predetermined threshold value.

4. An image display device, comprising:

a conversion section for converting an analog image signal into digital image data;

a memory for temporarily storing at least one frame of image data after being converted by the conversion section, and for outputting the image data; and a control section for comparing the display level of the pixel represented by the one frame of image data stored in the memory with a display level of the same pixel represented by a next one frame of image data after being converted by the conversion section, and for updating or not updating the display level of the pixel stored in the memory based on a comparison result, wherein when the comparison result indicates a slight variation in the display level between the one frame and the next one frame, the control section does not update the display level of the pixel stored in the memory, wherein a display level of each pixel is represented by a bit string; and the control section compares a first bit string representing the display level of the pixel stored in the memory with a second bit string representing a display level of the pixel for a next display, and for updating the display level of the pixel stored in the memory if a predetermined number of upper bits of the first bit string differ from the predetermined number of upper bits of the second bit string.

5. An image display device according to claim 4, wherein the control section updates the display level of the pixel stored in the memory if a difference between the display level of the pixel represented by the image data stored in the memory and the display level of the pixel represented by a next frame of image data is equal to or greater than a predetermined threshold value.

* * * * *